US007332062B1

(12) United States Patent
Reder et al.

(10) Patent No.: US 7,332,062 B1
(45) Date of Patent: Feb. 19, 2008

(54) ELECTROPLATING TOOL FOR SEMICONDUCTOR MANUFACTURE HAVING ELECTRIC FIELD CONTROL

(75) Inventors: Steven E. Reder, Boring, OR (US); Michael J. Berman, West Linn, OR (US)

(73) Assignee: LSI Logic Corporation, Milpitas, CA (US)

( * ) Notice: Subject to any disclaimer, the term of this patent is extended or adjusted under 35 U.S.C. 154(b) by 276 days.

(21) Appl. No.: 10/452,360

(22) Filed: Jun. 2, 2003

(51) Int. Cl.
*C25D 17/00* (2006.01)
*C25D 17/06* (2006.01)
*C25D 7/12* (2006.01)

(52) U.S. Cl. ..... 204/230.6; 204/230.7; 204/272

(58) Field of Classification Search ..... None
See application file for complete search history.

(56) References Cited

U.S. PATENT DOCUMENTS 4,828,654 A * 5/1989 Reed ..... 205/97
5,135,636 A * 8/1992 Yee et al. ..... 205/96
6,071,388 A * 6/2000 Uzoh ..... 204/287
2002/0000380 A1* 1/2002 Graham et al. ..... 205/102
2005/0056544 A1* 3/2005 Liu et al. ..... 205/223

FOREIGN PATENT DOCUMENTS

WO WO 00/61498 A2 * 10/2000

* cited by examiner

*Primary Examiner*—Harry D Wilkins, III
(74) *Attorney, Agent, or Firm*—Maginot, Moore & Beck

(57) ABSTRACT

An electroplating tool for providing a metal or metal film on a semiconductor wafer during processing thereof has a wafer chucking mechanism with a conductor or conductors associated therewith. The conductor(s) are electrically connected to a controller that applies a voltage or current applied thereto for altering the position of and/or varying the intensity of electromagnetic field lines originating from a source anode of the electroplating tool. The electromagnetic field lines originating from the source anode direct the deposition of metal from the electroplating solution to the semiconductor wafer. The conductor(s) of the wafer chucking mechanism improve and/or modulate the electromagnetic field lines of the electroplating process. This provides greater control of metal deposition during the electroplating process such that uniformity of the metal (e.g. copper) is provided across the semiconductor wafer.

19 Claims, 3 Drawing Sheets

ELECTROPLATING TOOL FOR SEMICONDUCTOR MANUFACTURE HAVING ELECTRIC FIELD CONTROL

BACKGROUND

1. Field of the Invention

The subject invention relates generally to electroplating systems for semiconductor technology and, more specifically, to an electroplating tool for semiconductor devices having electric field control.

2. Background Information

Semiconductor devices such as integrated circuits (ICs) form at least part of almost every electronic product. As semiconductor technology advances, the complexity of integrated circuits increases. This increased complexity typically results in smaller integrated circuit elements. Because of the decrease in size of the circuit elements, the techniques for producing the circuit elements, and thus the integrated circuit itself, need to be quite precise.

The manufacture of semiconductor devices involves many steps and processes. Some processes are utilized several times during the manufacture of a semiconductor device. There are many steps in the manufacture of semiconductor devices that require electroplating of certain metals, such as copper. Current electroplating processes can provide relatively good uniformity or non-uniformity on the semiconductor device as desired. These processes utilize various control methods in order to achieve uniformity/non-uniformity. Such current electroplating control methods include the use of chemical controls, basic process change controls, and the control of the basic electrical properties of the plating process.

While such existing approaches to the control of electroplating of semiconductor devices provide relatively good control of the uniformity or non-uniformity of the deposited metal, they lack fine control of the process. Particularly, the existing approaches lack the fine control of the final film thickness and, more particularly, lack the fine control of the uniformity/non-uniformity of the final film. The uniformity/non-uniformity of the deposited metal film and the ability to control and change the deposited metal film during the electroplating process in order to provide the best fit for the particular process, can be a key item in matching the film with the polishing or electro-polishing steps during semiconductor manufacture.

What is therefore needed in view of the above, is a system, method and/or apparatus for electroplating metals or metal films onto a semiconductor wafer during manufacture that offers greater control.

What is therefore further needed in view of the above, is a system, method and/or apparatus for electroplating metals or metal films onto a semiconductor wafer during manufacture that offers fine control of the final metal or metal film thickness.

What is therefore yet further needed in view of the above, is a system, method and/or apparatus for electroplating metals or metal films onto a semiconductor wafer during manufacture that offers fine control of the uniformity/non-uniformity of the final metal or metal film.

SUMMARY

The above needs are addressed by a system, apparatus and/or method that controls the electromagnetic field lines between an electroplating circuit of an electroplating apparatus.

In one form, the subject invention is an electroplating device. The electroplating device includes an electroplating receptacle adapted to retain an electroplating solution, an anode disposed in the electroplating receptacle, a DC voltage source coupled to the anode, a wafer chuck assembly adapted to releasably retain a semiconductor wafer for electroplating and coupled to the DC voltage source, the wafer chuck assembly having a conductor arrangement associated therewith, and a controller connected to the DC voltage source and the conductor arrangement and operative to cause the DC voltage source to apply a DC voltage to the anode and cathode for establishing an electromagnetic field therebetween, and apply an electrical control signal to the electrical conductor arrangement whereby the established electromagnetic field is altered proximate the semiconductor wafer.

In another form, the subject invention provides a method of electroplating a semiconductor wafer in an electroplating device. The method includes: (a) retaining a semiconductor wafer in a wafer chuck assembly of the electroplating device, the wafer chuck assembly operative as a cathode of an electroplating circuit of the electroplating device; (b) placing the wafer chuck assembly into an electroplating solution retained in an electroplating receptacle of the electroplating device; (c) applying a direct current to the electroplating circuit of the electroplating device to establish an electromagnetic field between the cathode of the electroplating circuit and an anode of the electroplating circuit that is disposed in the electroplating receptacle; and (d) applying an electrical signal to an electrical conductor arrangement associated with the wafer chuck assembly whereby the established electromagnetic field is altered proximate the semiconductor wafer.

In yet another form, the subject invention is a wafer chuck mechanism for retaining a semiconductor wafer in an electroplating apparatus. The wafer chuck mechanism includes a wafer housing adapted to be a cathode of an electroplating circuit, a wafer backing plate disposed in the wafer housing and adapted to receive a semiconductor wafer for electroplating, a contact ring associated with the wafer housing and adapted to provide electrical contact between the wafer housing and a semiconductor wafer for electroplating, and a conductor arrangement associated with the wafer chuck assembly, the conductor arrangement adapted to receive a conductor control signal whereby an electromagnetic field established proximate thereto is altered.

The subject invention provides the ability to modify, improve and/or modulate the electromagnetic field lines (field) produced by the electroplating process (i.e. the electroplating circuit). In general, this provides improvement in the uniformity of metal deposition on the semiconductor wafer. This is particularly seen at the edge areas of the semiconductor wafer.

The subject invention allows an electroplating tool to meet the uniformity needs of the post plating process to produce the best metal (e.g. copper) semiconductor element (e.g. interconnect) process on the completed semiconductor wafer. By providing a better focus of the field lines from the electroplating circuit that tend to converge at the edges of the wafer, this improves gap fill by the particular metal (e.g. copper), most particularly at the edge of the wafer. Overall, the subject invention improves the uniformity of metal deposition on the semiconductor wafer.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views unless specified otherwise.

DESCRIPTION OF THE PREFERRED EMBODIMENT(S)

Figure 1:
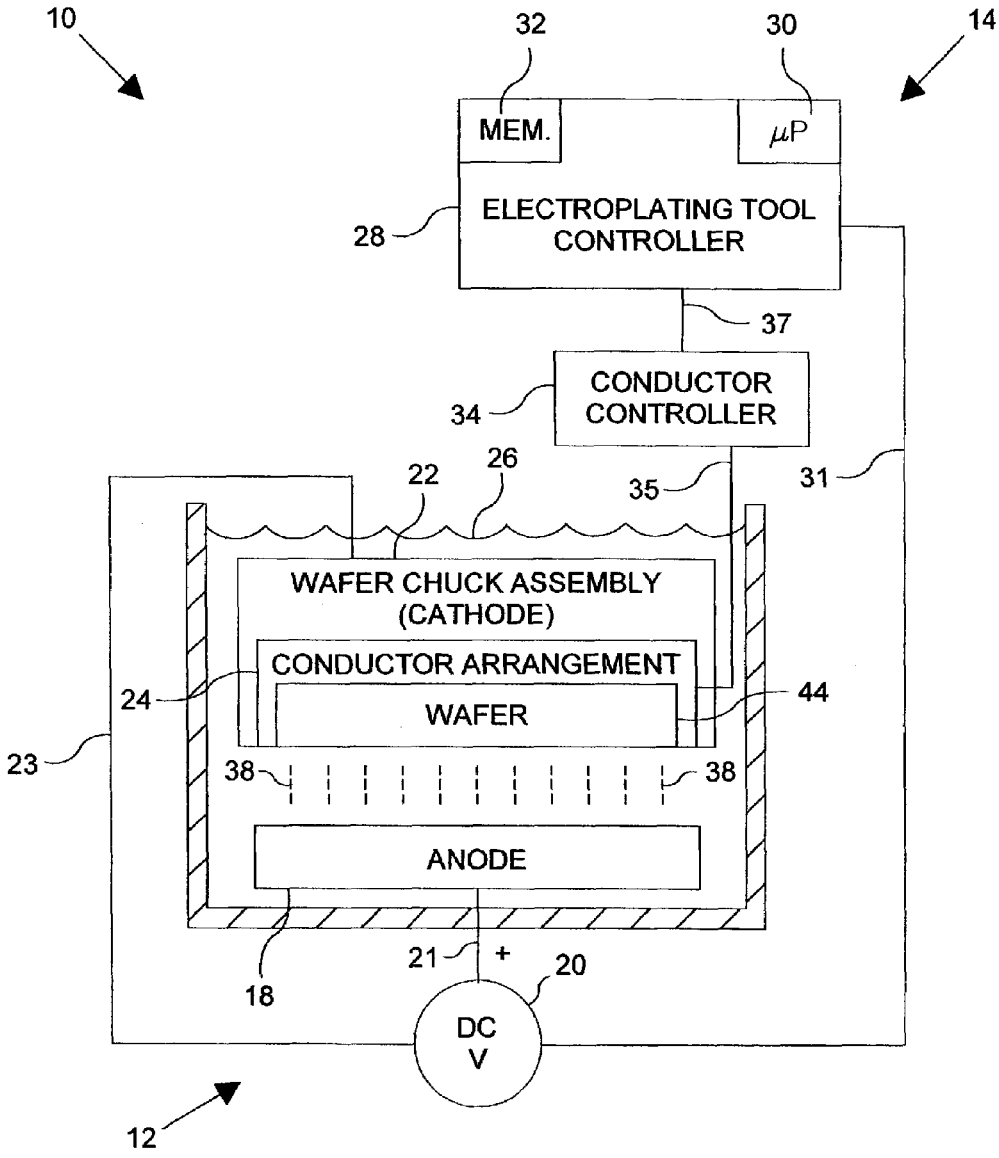
FIG. 1 is a representation of an electroplating tool/system incorporating an embodiment of the subject invention.

With reference now to FIG. 1, there is shown a representation of an exemplary electroplating system generally designated 10 in which the subject invention is incorporated and/or is a part thereof. The electroplating system 10 includes an electroplating tool 12 that is coupled to an electroplating control system 14. In general, the electroplating tool 12 is operative, configured and/or adapted to apply, form, deposit or the like, a metal, such as copper, onto a workpiece, such as a semiconductor wafer. The electroplating tool 12 uses the process of electroplating to accomplish the application of the metal. It should be understood that while the subject electroplating tool 12 may be used to provide the electroplating of various metals onto a semiconductor wafer for fabrication or manufacture of various components or elements of integrated circuits, the subject invention will be discussed with respect to the electroplating of the metal copper for interconnects of an integrated circuit. Therefore, it should be appreciated that the subject invention is not limited to the electroplating of copper interconnects onto a semiconductor wafer.

The electroplating tool 12 includes an electroplating receptacle, tank or the like 16 such as is known in the art. The receptacle 16 is adapted, configured and/or operative to hold an electroplating solution, the electroplating solution being of a type known in the art for the particular metal to be applied to the semiconductor. A first electrical terminal forming part of an electroplating circuit is disposed in the receptacle 16. Typically, because of the position of the first electrical terminal 18 in the receptacle 16, the first electrical terminal is an anode of the electroplating circuit. The anode 18 is connected via an appropriate electrical line 21 to the positive (+) side of a source of DC electricity 20.

The electroplating tool 12 further includes a wafer chuck assembly or mechanism 22. The wafer chuck assembly 22 forms a second electrical terminal in the electroplating circuit. Since the first electrical terminal 18 is typically the anode of the electroplating circuit, the second electrical terminal is a cathode. While not specifically shown, the wafer chuck assembly 22 may be removable from the receptacle 16 in order to releasably receive and retain a semiconductor wafer. Alternatively, other manners of releasably receiving a semiconductor wafer may be used.

In accordance with an aspect of the subject invention, the wafer chuck assembly 22 includes a conductor arrangement 24. The conductor arrangement 24 is strategically situated with respect to the wafer chuck assembly 22 and/or one or more of the various components of the wafer chuck assembly 22. In general, the conductor arrangement 24 is adapted, configured and/or operative to modify, alter and/or change the electromagnetic field lines (represented by the lines 38) between the anode 18 and the cathode 22 during the electroplating process (i.e. when the electroplating circuit is active) particularly when an electrical signal is applied to the conductor arrangement 24. Particularly, the conductor arrangement 24 is operative to alter the position and/or vary the intensity of the electromagnetic field lines 38 originating from the source anode 18. The field lines 38 are controlled such that an improved uniformity of copper deposition is achieved. Such control may include modulation of the electromagnetic field lines of the plating process to meet uniformity needs of the post plating processing (e.g. CMP or electropolishing).

Strategic placement of the conductor arrangement 24 includes surrounding a particular component or components of the wafer chuck assembly, being adjacent to a particular component or components of the wafer chuck assembly, being integral with a particular component or components of the wafer chuck assembly, or any combination of the aforementioned configurations. The conductor arrangement 24 may be comprised of one or more electrically conductive components configured in the manner set forth above.

The electroplating control system 14 of the electroplating system 10 is operative, configured and/or adapted to control the application, deposition, formation or the like of copper onto a semiconductor wafer that has been releasably retained on the wafer chuck assembly 22. The electroplating control system 14 includes an electroplating tool controller 28 and a conductor controller 34. The electroplating tool controller 28 is adapted, configured and/or operative to control the electroplating tool 12, one aspect of which is the control of the DC voltage source 20. This is accomplished via the DC voltage source control line 31. Other aspects of the control function of the electroplating tool controller 28 such as are known in the art, while not particularly shown or addressed herein, are also accomplished by the electroplating tool controller 28.

The DC voltage source 20 applies a DC voltage between the anode 18 and the cathode 22. This produces an electromagnetic field (electromagnetic field lines or field lines 38) between the anode 18 and the cathode 22. A current is thus induced to flow on wafer 44 for electroplating of copper on the wafer 44.

The electroplating tool controller 28 includes a microprocessor (μP), processor, and/or processing circuitry/logic 30 such as is known in the art for electroplating tool controllers or computers. Additionally, the electroplating controller 28 has memory 32 such as either or both static and dynamic memory for various purposes such as are known in the art. One such purpose is the storing of program instructions or software for the operation of the electroplating system 10 including the control of the DC voltage source for the electroplating circuit. The program instructions are executable by the processor 30.

While separately shown in FIG. 1, the conductor controller 34 may be integral with the electroplating tool controller 28. When the conductor controller 34 is separate from the electroplating tool controller 28, the conductor controller 34 is in communication with the electroplating tool controller 28 via a communication line 37. In all cases, the conductor controller 34 is adapted, configured and/or operative to control the conductor arrangement 24. Particularly, the conductor controller 34 is operative to apply a voltage signal, a current signal, or both (collectively, a conductor arrangement control signal) to the conductor arrangement 24. The conductor arrangement control signal causes the conductor arrangement 24 to alter, modify, modulate, and/or change the intensity, configuration and/or position of the electromagnetic field/field lines 38.

To this end, the memory 32 stores program instructions that allow communication with the conductor controller 34 via line 37 and which may provide control instructions thereto. The conductor controller 34 may receive information from the electroplating tool controller 28 for the type and/or manner of electroplating to be performed on the semiconductor wafer 44. Since the semiconductor wafer 44 may undergo various types and/or manners of electroplating corresponding to various stages of manufacture and/or type of component or element being fabricated, the conductor controller 34 is operative to provide various conductor arrangement control signals to the conductor arrangement as appropriate. The conductor arrangement 24 is operative to receive the various conductor arrangement control signals and create its own electric field. The conductor arrangement electric field alters the position and/or varies the intensity of the electromagnetic field lines 38 originating from the source anode 18 accordingly.

The memory 32 may store values, parameters and/or the like related to particular electroplating processes with respect to the manufacture of semiconductor wafers into integrated circuits. These may be used by the conductor controller 34 in the generation of appropriate conductor arrangement control signals. It should be appreciated that, while not shown, the conductor controller includes, at a minimum, circuitry/logic for operation thereof, and may contain its own memory and/or processor.

Figure 2:
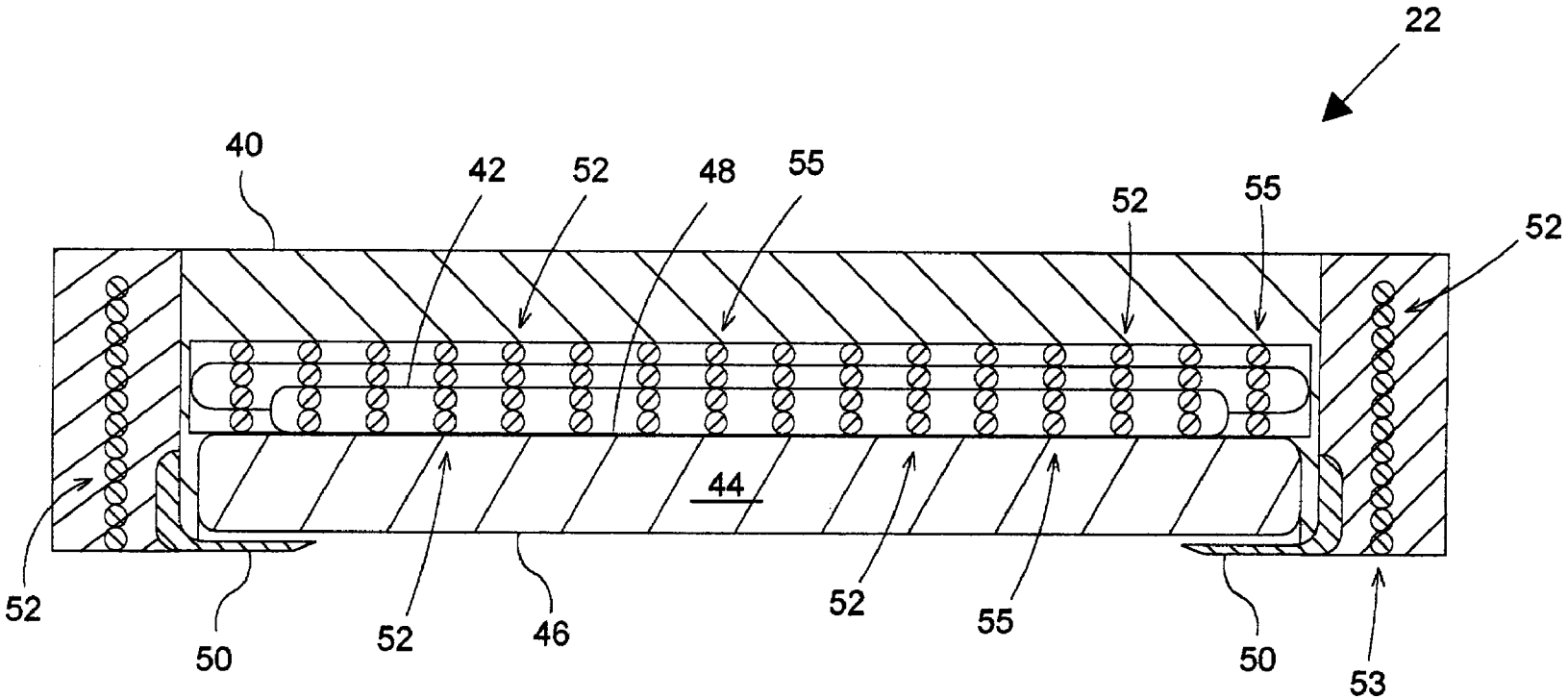
FIG. 2 is an enlarged, sectional view of a wafer chuck assembly or mechanism in accordance with the principles of the subject invention.

Referring now to FIG. 2, there is depicted an embodiment of the wafer chuck assembly or mechanism 22, the wafer chuck assembly 22 shown in sectional. The wafer chuck assembly 22 has a housing, frame and/or the like 40 that is coupled to the DC voltage source 20 via line 23 (see FIG. 1) such that the housing 40 forms the cathode portion of the electroplating circuit. The housing 40 supports a backing plate 42 that is configured, adapted and/or operative to receive the semiconductor wafer 44. Particularly, a bottom surface 48 of the semiconductor wafer 44 abuts the backing plate 42 while a top surface 46 of the semiconductor wafer 44 is at least partially exposed and situated to face the anode 18. The wafer chuck assembly 22 further has a contact ring 50.

The contact ring 50 retains the wafer 44 in position on the wafer chuck assembly as well as being a part of the cathode of the wafer chuck assembly. The contact ring 50 is preferably, but not necessarily, annular in accordance with semiconductor wafers which are typically annular. The contact ring 50 extends a distance radially inwardly from an outside edge of the wafer 44 to the center thereof. Since the contact ring 50 is part of the cathode, the contact ring distorts (converges) the electrostatic field/field lines somewhat at or near the edges of the semiconductor wafer 44. It is this distortion that creates the prior art inability to provide the fine control of the metal deposition, particularly at or near the edges of the semiconductor wafer 44.

In accordance with an aspect of the subject invention, the wafer chuck assembly 22 includes one or more conductors 52 (and preferably a plurality of conductors 52) that form the conductor arrangement 24. One set 53 of conductors 52 is disposed adjacent to the contact ring 50. The set 53 is composed of a plurality of stacked conductor rings, each ring of which essentially surrounds (or is radially outward of) the contact ring 50 (wherein each one of the individual conductors of the set 53 is identified by a circle). This set 53 of conductors 52 may be used to control the electrostatic field along the outer edge of the semiconductor wafer 44, especially proximate the contact ring 50. It should be appreciated that while there is only one set or stack 53 of conductors or conductor rings 52 shown associated with the wafer chuck assembly 22 and radially outwardly of the semiconductor wafer 44, two or more sets or stacks may be used. It should be appreciated that while a plurality of individual conductor forming the stack 53 is shown, a single conductor may be used.

The set 53 (i.e. each conductor 52) is electrically connected to the conductor controller 34 in order to be operative to receive the conductor arrangement control signal(s) therefrom. In one form, each conductor 52 of the set or stack 53 receives the same conductor arrangement control signal. In another form, a subset or subsets of conductors 52 of the stack 53 each receive different conductor arrangement control signals. Various combinations are contemplated.

Other stacks 55 of conductors or conductor rings 52 may be associated with the wafer chuck assembly 22. In FIG. 2, the plurality of stacks 55 is axially situated with respect to the semiconductor wafer 44. Each stack 55 is composed of a plurality of stacked conductor rings 52, each ring of which is essentially coaxial with the wafer 44 (wherein each one of the individual conductors 52 of a stack 55 is identified by a circle). Each stack 55 is concentric with a radially adjacent stack. These stacks 55 of conductors 52 may be used to control the electrostatic field along the inner portions of the semiconductor wafer 44. It should be appreciated that while there are a plurality of stacks 55 of conductors or conductor rings 52 shown associated with the wafer chuck assembly 22 less stacks 55 than shown may be used.

The stacks 55 (i.e. each conductor 52) are electrically connected to the conductor controller 34 in order to be operative to receive the conductor arrangement control signal(s) therefrom. In one form, all of the stacks (i.e. each conductor thereof) are commonly connected to the conductor controller 34 to receive a common conductor arrangement control signal. In another form, each stack 55 is separately connected to the conductor controller 34 so as to each receive a separate conductor arrangement control signal. In yet another form, each conductor 52 of the set or stack 53 receives the same conductor arrangement control signal. In another form, a subset or subsets of stacks 55 each receive different conductor arrangement control signals. Other and various combinations are additionally contemplated.

While the conductors 52 are shown as having the same configuration and/or size, it should be appreciated that the conductors 52 may be of different and/or various sizes according to the manner in which the electromagnetic field may be desired to be altered. Additionally, the conductor arrangement control signal or signals from the conductor controller 34 may be the same or different for various conductors, stacks of conductors, subsets of conductors or the like. Moreover, the conductor arrangement control signal (s) may either stay the same for a particular electroplating process or may change during the particular electroplating process.

It should be appreciated that the configuration of conductors shown in FIG. 2 is only exemplary. As such, there are many manners and configurations of conductors that may be used in accordance with the principles of the subject invention.

Figure 3:
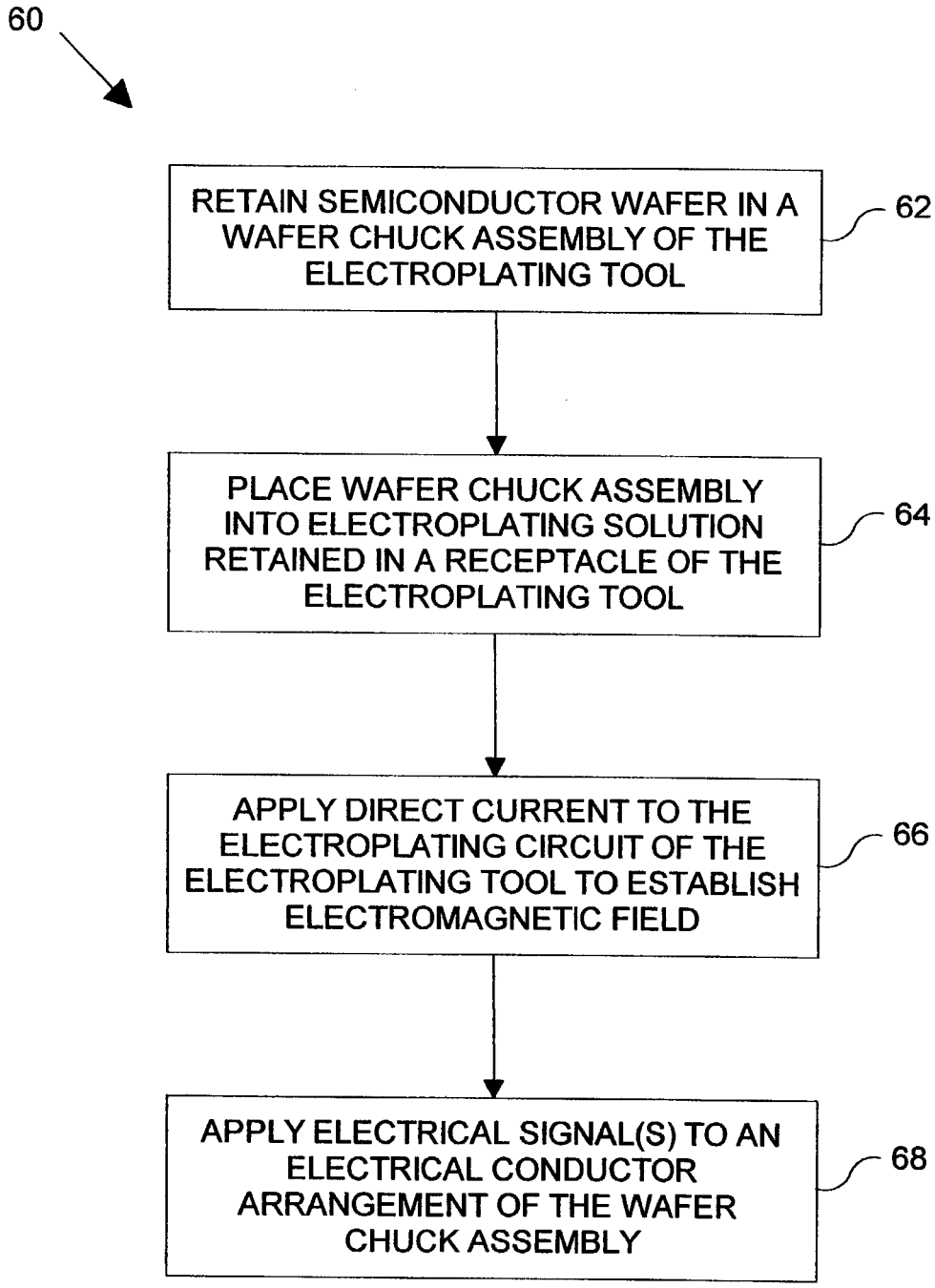
FIG. 3 is a flowchart of an exemplary manner of operation of the subject invention.

Referring now to FIG. 3, there is depicted a flowchart, generally designated 60, of an exemplary manner of operation of the electroplating system 10 in accordance with the present principles. In step 62, a semiconductor wafer is releasably retained in the subject wafer chuck assembly of the electroplating tool or device. In step 64, the wafer chuck assembly is then placed into the electroplating solution held in the receptacle of the electroplating tool.

Thereafter, in step 66, a direct current voltage is applied to the electroplating circuit of the electroplating tool to establish an electromagnetic field for electroplating the semiconductor wafer. In step 68, an electrical conductor arrangement control signal(s) is applied to the electrical conductor arrangement of the wafer chuck assembly.

While this invention has been described as having a preferred design and/or configuration, the subject invention can be further modified within the spirit and scope of this disclosure. This application is therefore intended to cover any variations, uses, or adaptations of the invention using its general principles. Further, this application is intended to cover such departures from the subject disclosure as come within known or customary practice in the art to which this invention pertains and which fall within the limits of the appended claims.

What is claimed is:

1. A wafer chuck assembly for a semiconductor wafer electroplating tool, the wafer chuck assembly comprising:

a wafer housing adapted to be a cathode of an electroplating circuit;

a wafer backing plate disposed in the wafer housing and adapted to receive a semiconductor wafer for electroplating;

a contact ring associated with the wafer housing and adapted to provide electrical contact between the wafer housing and a semiconductor wafer for electroplating; and a conductor arrangement associated with the wafer chuck assembly, the conductor arrangement including a plurality of annular conductors arranged coaxial to a received semiconductor wafer and including at least one annular conductor arranged radially outwardly of the received semiconductor wafer, the conductor arrangement adapted to receive a conductor control signal from a conductor controller operable to provide a plurality of conductor control signals to the conductor arrangement, whereby an electromagnetic field established proximate thereto using the contact ring is altered, wherein the plurality of annular conductors comprise at least one annular conductor arranged between the wafer backing plate and the received semiconductor wafer.

2. The wafer chuck assembly of claim 1 wherein the at least one annular conductor arranged between the wafer backing plate and the received semiconductor wafer is configured to control an electrostatic field along the inner portions of the received semiconductor wafer.

3. The wafer chuck assembly of claim 1 wherein the at least one annular conductor arranged between the wafer backing plate and the received semiconductor wafer is configured to control an electrostatic field along an outer edge of the received semiconductor wafer.

4. The wafer chuck assembly of claim 1 wherein the conductor controller is operable to deliver different conductor control signals to the at least one annular conductor arranged between the wafer backing plate and the received semiconductor wafer and the at least one annular conductor arranged radially outwardly of the received semiconductor wafer.

5. A wafer chuck assembly for a semiconductor wafer electroplating tool, the wafer chuck assembly comprising:

a wafer housing adapted to be a cathode of an electroplating circuit;

a wafer backing plate disposed in the wafer housing and adapted to receive a semiconductor wafer for electroplating;

a contact ring associated with the wafer housing and adapted to provide electrical contact between the wafer housing and a semiconductor wafer for electroplating; and a conductor arrangement associated with the wafer chuck assembly, the conductor arrangement including a plurality of annular conductors arranged coaxial to a received semiconductor wafer and including at least one annular conductor arranged radially outwardly of the received semiconductor wafer, the conductor arrangement adapted to receive a conductor control signal from a conductor controller operable to provide a plurality of conductor control signals to the conductor arrangement, whereby an electromagnetic field established proximate thereto using the contact ring is altered, wherein the plurality of annular conductors are arranged in a plurality of coaxial stacks of conductors, with each coaxial stack being concentric with one another.

6. A wafer chuck assembly for a semiconductor wafer electroplating tool, the wafer chuck assembly comprising:

a wafer housing adapted to be a cathode of an electroplating circuit;

a wafer backing plate disposed in the wafer housing and adapted to receive a semiconductor wafer for electroplating;

a contact ring associated with the wafer housing and adapted to provide electrical contact between the wafer housing and a semiconductor wafer for electroplating; and a conductor arrangement associated with the wafer chuck assembly, the conductor arrangement including a plurality of annular conductors arranged coaxial to a received semiconductor wafer and including at least one annular conductor arranged radially outwardly of the received semiconductor wafer, the conductor arrangement adapted to receive a conductor control signal from a conductor controller operable to provide a plurality of conductor control signals to the conductor arrangement, whereby an electromagnetic field established proximate thereto using the contact ring is altered, wherein the conductor arrangement comprises a plurality of stacked annular conductors arranged radially outwardly of a received semiconductor wafer.

7. A wafer chuck assembly for a semiconductor wafer electroplating tool, the wafer chuck assembly comprising:

a wafer housing adapted to be a cathode of an electroplating circuit;

a wafer backing plate disposed in the wafer housing and adapted to receive a semiconductor wafer for electroplating;

a contact ring associated with the wafer housing and adapted to provide electrical contact between the wafer housing and a semiconductor wafer for electroplating; and a conductor arrangement associated with the wafer chuck assembly, the conductor arrangement including a plurality of annular conductors arranged coaxial to a received semiconductor wafer and including at least one annular conductor arranged radially outwardly of the received semiconductor wafer, the conductor arrangement adapted to receive a conductor control signal from a conductor controller operable to provide a plurality of conductor control signals to the conductor arrangement, whereby an electromagnetic field established proximate thereto using the contact ring is altered, wherein the conductor arrangement comprises a plurality of stacked annular conductors arranged radially outwardly of a received semiconductor wafer, and a plurality of annular conductors arranged coaxial to the received semiconductor wafer.

8. A wafer chuck assembly for a semiconductor wafer electroplating tool, the wafer chuck assembly comprising:

a wafer housing adapted to be a cathode of an electroplating circuit;

a wafer backing plate disposed in the wafer housing and adapted to receive a semiconductor wafer for electroplating;

a contact ring associated with the wafer housing and adapted to provide electrical contact between the wafer housing and a semiconductor wafer for electroplating; and a conductor arrangement included in the wafer chuck assembly, the conductor arrangement including a plurality of annular conductors arranged coaxial to a received semiconductor wafer and including at least one annular conductor arranged radially outwardly of the received semiconductor wafer, the conductor arrangement adapted to receive a conductor control signal from a conductor controller operable to provide a plurality of conductor control signals to the conductor arrangement, whereby an electromagnetic field established proximate thereto using the contact ring is altered, wherein the plurality of annular conductors comprise a first set of annular conductors and a second set of annular conductors, and the conductor controller is operable to deliver a first conductor control signal to the first set of annular conductors and a second conductor control signal to the second set of annular conductors, wherein the first conductor control signal is different from the second conductor control signal.

9. A wafer chuck assembly for a semiconductor wafer electroplating tool, the wafer chuck assembly comprising:

a wafer housing adapted to be a cathode of an electroplating circuit;

a wafer backing plate disposed in the wafer housing and adapted to receive a semiconductor wafer for electroplating;

a contact ring associated with the wafer housing and adapted to provide electrical contact between the wafer housing and a semiconductor wafer for electroplating; and a conductor arrangement associated with the wafer chuck assembly, the conductor arrangement including a plurality of annular conductors arranged in a plurality of coaxial stacks of conductors, the conductor arrangement adapted to receive a conductor control signal from a conductor controller operable to provide a plurality of conductor control signals to the conductor arrangement, whereby an electromagnetic field established proximate thereto is altered.

10. The wafer chuck assembly of claim 9 wherein the plurality of annular conductors comprise at least one annular conductor arranged radially outwardly of the received semiconductor wafer and at least one annular conductor arranged between the wafer backing plate and the received semiconductor wafer.

11. The wafer chuck assembly of claim 10 wherein the at least one annular conductor arranged between the wafer backing plate and the received semiconductor wafer is configured to control an electrostatic field along the inner portions of the received semiconductor wafer.

12. The wafer chuck assembly of claim 10 wherein the conductor controller is operable to deliver different conductor control signals to the at least one annular conductor arranged between the wafer backing plate and the received semiconductor wafer and the at least one annular conductor arranged radially outwardly of the received semiconductor wafer.

13. The wafer chuck assembly of claim 9 wherein the conductor arrangement comprises a plurality of stacked annular conductors arranged radially outwardly of a received semiconductor wafer, and a plurality of annular conductors arranged coaxial to the received semiconductor wafer.

14. The wafer chuck assembly of claim 9 wherein the plurality of annular conductors comprise a first set of annular conductors and a second set of annular conductors, and the conductor controller is operable to deliver a first conductor control signal to the first set of annular conductors and a second conductor control signal to the second set of annular conductors, wherein the first conductor control signal is different from the second conductor control signal.

15. A wafer chuck assembly for a semiconductor wafer electroplating tool, the wafer chuck assembly comprising:

a wafer housing adapted to be a cathode of an electroplating circuit;

a wafer backing plate disposed in the wafer housing and adapted to receive a semiconductor wafer for electroplating;

a contact ring associated with the wafer housing and adapted to provide electrical contact between the wafer housing and a semiconductor wafer for electroplating; and a conductor arrangement associated with the wafer chuck assembly, the conductor arrangement including a plurality of stacked annular conductors arranged radially outwardly of a received semiconductor wafer, the conductor arrangement adapted to receive a conductor control signal from a conductor controller operable to provide a plurality of conductor control signals to the conductor arrangement, whereby an electromagnetic field established proximate thereto is altered.

16. The wafer chuck assembly of claim 15 wherein the conductor arrangement comprises at least one annular conductor arranged between the wafer backing plate and the received semiconductor wafer.

17. The wafer chuck assembly of claim 16 wherein the at least one annular conductor arranged between the wafer backing plate and the received semiconductor wafer is configured to control an electrostatic field along the inner portions of the received semiconductor wafer.

18. The wafer chuck assembly of claim 16 wherein the conductor controller is operable to deliver different conductor control signals to the at least one annular conductor arranged between the wafer backing plate and the received semiconductor wafer and the at least one annular conductor arranged radially outwardly of the received semiconductor wafer.

19. The wafer chuck assembly of claim 15 wherein the conductor arrangement comprises a first set of annular conductors and a second set of annular conductors, and the conductor controller is operable to deliver a first conductor control signal to the first set of annular conductors and a second conductor control signal to the second set of annular conductors, wherein the first conductor control signal is different from the second conductor control signal.

* * * * *